US008322998B2

(12) United States Patent
Hanaoka et al.

(10) Patent No.: US 8,322,998 B2
(45) Date of Patent: Dec. 4, 2012

(54) SERIAL AXIAL FAN

(75) Inventors: Satoru Hanaoka, Kyoto (JP); Takahiro Kikuichi, Kyoto (JP); Hidenobu Takeshita, Kyoto (JP)

(73) Assignee: Nidec Corporation, Kyoto (JP)

( * ) Notice: Subject to any disclaimer, the term of this patent is extended or adjusted under 35 U.S.C. 154(b) by 746 days.

(21) Appl. No.: 12/504,875

(22) Filed: Jul. 17, 2009

(65) Prior Publication Data

US 2010/0021317 A1 Jan. 28, 2010

(30) Foreign Application Priority Data

Jul. 25, 2008 (JP) ..... 2008-191641

(51) Int. Cl.

| | |
|---|---|
| ***F01D 1/10*** | (2006.01) |
| ***F01D 1/26*** | (2006.01) |
| ***F01D 13/00*** | (2006.01) |
| ***F01D 25/26*** | (2006.01) |
| ***F01D 25/28*** | (2006.01) |
| ***F03D 3/02*** | (2006.01) |
| ***F04D 25/16*** | (2006.01) |
| ***F04D 29/60*** | (2006.01) |

(52) U.S. Cl. ..... 417/244; 417/423.14; 415/68; 415/213.1

(58) Field of Classification Search ..... 415/66, 415/68, 208.1, 208.2, 211.2, 213.1; 417/244, 417/360, 361, 363, 423.15, 423.14, 424.1
See application file for complete search history.

(56) References Cited

U.S. PATENT DOCUMENTS

| | | | | |
|---|---|---|---|---|
| 6,612,817 | B2 * | 9/2003 | Lin et al. | 417/423.5 |
| 2005/0106026 | A1 * | 5/2005 | Oosawa et al. | 416/198 R |
| 2007/0059155 | A1 * | 3/2007 | Ishihara et al. | 415/60 |
| 2008/0260530 | A1 * | 10/2008 | Nishizawa et al. | 415/220 |

FOREIGN PATENT DOCUMENTS

| | | | |
|---|---|---|---|
| JP | 2002-349476 | A | 12/2002 |
| JP | 2004-278370 | A | 10/2004 |

* cited by examiner

*Primary Examiner* — Devon Kramer
*Assistant Examiner* — Bryan Lettman
(74) *Attorney, Agent, or Firm* — Keating & Bennett, LLP

(57) ABSTRACT

A serial axial fan includes first and second axial fans. Each of the first and second axial fans includes a base portion and a plurality of support ribs arranged to connect the base portions to housings. The first and second axial fans are coupled together with the base portions thereof either in contact with or in close proximity to each other. Each of the support ribs in each of the first and second axial fans extends over both housings of the first and second axial fans.

10 Claims, 19 Drawing Sheets

24

SERIAL AXIAL FAN

BACKGROUND OF THE INVENTION

1. Field of the Invention

The present invention relates to a fan unit, and more specifically to a fan unit including a plurality of axial fans connected in series.

2. Description of the Related Art

Cooling fans are used for cooling electronic parts inside a casing of various electronic devices. The cooling fans are required to have improved air flow characteristics, i.e., an improved static pressure vs. flow rate curve with an increase in the amount of heat generation associated with a performance improvement of the electronic parts and the increase in the density of the electronic parts associated with a size reduction of the casing. As an exemplary cooling fan which can provide a sufficient static pressure and a sufficient flow rate, a serial axial fan unit is currently used which includes a plurality of axial fans connected in series.

SUMMARY OF THE INVENTION

An advantage of preferred embodiments of the present invention is a reduction in the turbulence in air flow caused by support ribs in a serial axial fan while still ensuring rigidity of the support ribs.

According to a preferred embodiment of the present invention, there is provided a serial axial fan including first and second axial fans. The first axial fan preferably includes a first base portion, a first motor portion supported by the first base portion, a first impeller including a plurality of first blades, a first housing arranged to enclose an outer circumference of the first impeller, and a plurality of first support ribs arranged to connect the first base portion to the first housing. The second axial fan preferably includes a second base portion, a second motor portion supported by the second base portion, a second impeller including a plurality of second blades, a second housing arranged to enclose an outer circumference of the second impeller, and a plurality of second support ribs arranged to connect the second base portion to the second housing. The first and second axial fans are coupled to each other with the first and second base portions either in contact with or in close proximity to each other (i.e., are adjacent to each other but not in contact with one another). A portion of each of the first support ribs on the first impeller side is positioned within the first housing, while a portion on the second impeller side of each of the first support ribs is positioned within the second housing. A portion of each of the second support ribs on the second impeller side is positioned within the second housing, while a portion on the first impeller side of each of the second support ribs is positioned within the first housing.

The serial axial fan according to the various preferred embodiments of the present invention achieves a reduction in the turbulence in air flow caused by the support ribs while ensuring the rigidity of the support ribs.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Serial axial fans according to preferred embodiments of the present invention include first and second axial fans. Each of the first and second axial fans preferably includes a plurality of support ribs arranged to connect a base portion and a housing to one another. The first and second axial fans are coupled to each other with their respective base portions either in contact with or in close proximity to each other. Each of the support ribs in each of the first and second axial fans extends over the housings of both the first and second axial fans.

Hereinafter, the present invention will be described with reference to the preferred embodiments.

First Preferred Embodiment

Figure 1:
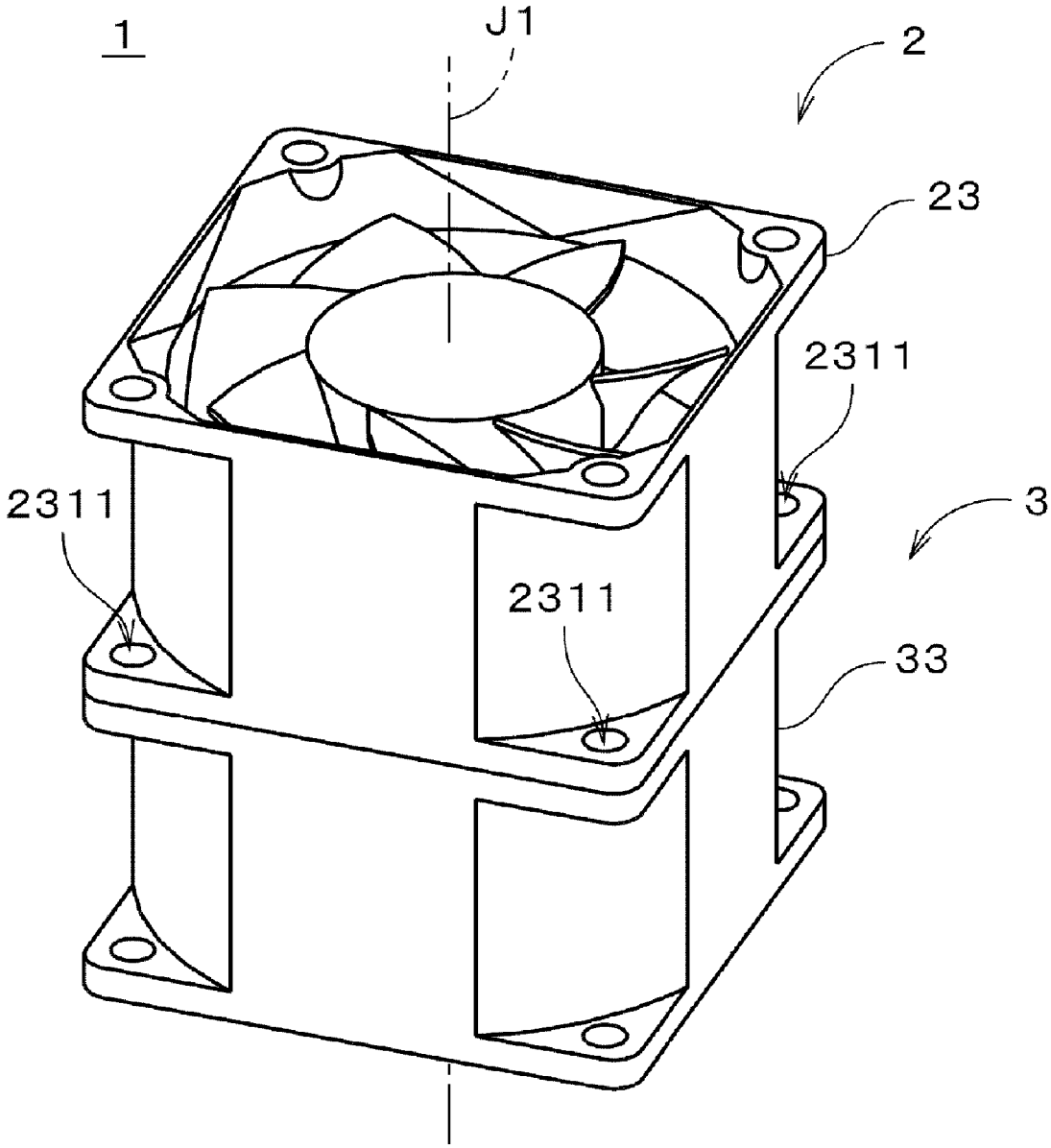
FIG. 1 is a perspective view of a serial axial fan according to a first preferred embodiment of the present invention.

FIG. 1 is a perspective view of a serial axial fan 1 according to a first preferred embodiment. The serial axial fan 1 is preferably used as a cooling fan to air-cool an electronic device such as a server, for example. The serial axial fan 1 includes first and second axial fans 2 and 3. In FIG. 1, the first axial fan 2 is arranged above the second axial fan 3. In the serial axial fan 1, the first and second axial fans 2 and 3 share a common central axis. This central axis in the serial axial fan 1 will be hereinafter referred to as a "central axis J1".

The serial axial fan 1 is a so-called counter-rotating axial fan. In the serial axial fan 1, air is drawn in from above the first axial fan 2 as in FIG. 1 and sent downward toward and eventually out through the second axial fan 3, resulting in a flow of the air along the central axis J1.

In the following description, as regards directions parallel or substantially parallel to the central axis J1, the upper side in FIG. 1, where the air is drawn into the serial axial fan 1, will be referred to simply as an "upper side" as appropriate, whereas the lower side in FIG. 1, where the air exits the serial axial fan 1, will be referred to simply as a "lower side" as appropriate. Note that the terms "upper side" and "lower side" may not necessarily correspond to upper and lower sides, respectively, with respect to the direction of gravity.

Furthermore, any reference below to parallel includes both "parallel" and "substantially parallel," and any reference below to perpendicular includes both "perpendicular" and "substantially perpendicular."

Figure 2:
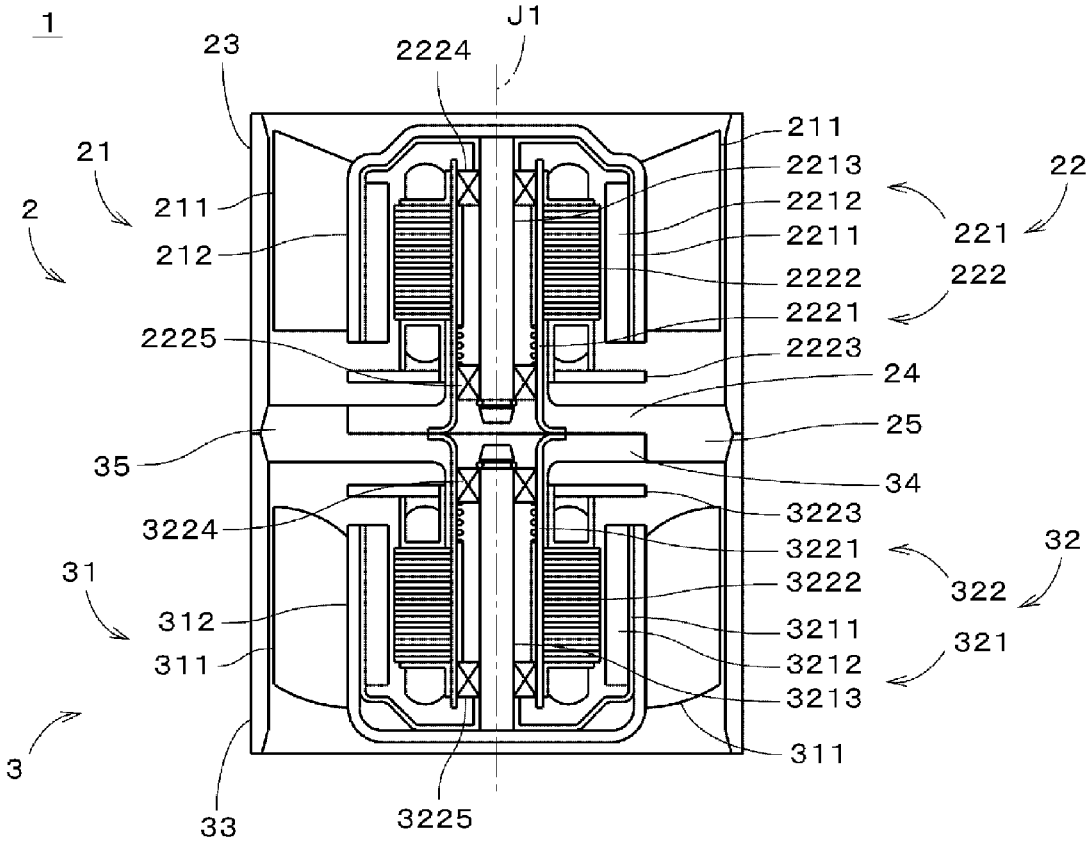
FIG. 2 is a vertical cross-sectional view of the serial axial fan.

FIG. 2 is a vertical cross-sectional view of the serial axial fan 1 drawn along a plane including the central axis J1. The first axial fan 2 preferably includes a first impeller 21, a first motor portion 22, a first housing 23, a first base portion 24, and a plurality of first support ribs 25. The first motor portion 22 rotates the first impeller 21. The first housing 23 encloses an outer circumference of the first impeller 21. The first base portion 24 supports the first motor portion 22. The first support ribs 25 connect the first base portion 24 and the first housing 23 to each other. In the present preferred embodiment, the number of first support ribs 25 is preferably two, for example. In FIG. 2, only one of the first support ribs 25 and only one of two second support ribs 35 of the second axial fan 3 are shown in order to illustrate both the first and second support ribs 25 and 35. The first housing 23, the first base portion 24, and the first support ribs 25 are preferably produced by resin injection molding to form a single member. However, any other desirable production method could be used. Note that, in FIG. 2, first blades 211 of the first impeller 21 and the first support ribs 25 are shown only in outline for convenience of illustration. The first motor portion 22 is shown in exaggerated size. In FIG. 2, hatching that should be applied to cross-sections of components is omitted. The same method is applied to the illustration of the second axial fan 3.

The first impeller 21 preferably includes a plurality of first blades 211 and a cup 212, which substantially has the shape of a covered cylinder and is arranged to cover the exterior of the first motor portion 22. The first blades 211 extend radially outward from an outer side surface of the cup 212, and are arranged at regular intervals in a circumferential direction. The first motor portion 22 includes a first rotor portion 221, i.e., a rotor, and a first stator portion 222, i.e., a stator. The first rotor portion 221 is arranged on the upper side of the first stator portion 222 along the central axis J1.

The first rotor portion 221 preferably includes a metallic yoke 2211, a substantially cylindrical field magnet 2212, and a shaft 2213. The metallic yoke 2211 substantially has the shape of a covered cylinder, and is centered about the central axis J1. The field magnet 2212 is substantially cylindrical and fixed to an inside of the yoke 2211. The shaft 2213 extends downward from a center of an upper portion of the yoke 2211. The yoke 2211 in the first rotor portion 221 is preferably covered by the cup 212, so that the first rotor portion 221 is combined with the first impeller 21.

The first stator portion 222 includes a bearing support portion 2221, an armature 2222, and a circuit board 2223. The bearing support portion 2221 is substantially cylindrical, and extends upward from a center of the first base portion 24. The armature 2222 is attached to an outer circumference of the bearing support portion 2221. The circuit board 2223 is preferably arranged below the armature 2222, and electrically connected to the armature 2222. The armature 2222 is arranged radially opposite the field magnet 2212. Ball bearings 2224 and 2225 are spaced apart from each other at upper and lower positions inside the bearing support portion 2221 along the central axis J1 to define a bearing mechanism. The shaft 2213 inserted in the bearing support portion 2221 is rotatably supported by the ball bearings 2224 and 2225.

The second axial fan 3 preferably has substantially the same shape and structure as those of the first axial fan 2 turned upside down. Therefore, the above description of the first axial fan 2 can be applied as a description of the second axial fan 3 by replacing the term "first axial fan 2" with the term "second axial fan 3", and "first" with "second" in the terms of the components, and changing a starting numeral of each reference numeral from "2" to "3". For example, the term "first impeller 21" in the description of the first axial fan 2 is replaced with the term "second impeller 31" in the description of the second axial fan 3.

Similarly, a second motor portion 32 has the substantially same structure as the first motor portion 22. Therefore, the above description of the first motor portion 22 can be applied as a description of the second motor portion 32 in a similar manner.

In the first axial fan 2 of the serial axial fan 1, the first motor portion 22 causes the first impeller 21 to rotate to produce air flow along the central axis J1. In the second axial fan 3, the second motor portion 32 causes the second impeller 31 to rotate in a direction opposite to a rotation direction of the first impeller 21, to produce air flow in the same direction as that of the air flow produced by the first impeller 21. Thus, the direction of the whirling components of the air flow produced by the first impeller is changed efficiently by the second impeller rotating in the opposite direction to the rotation direction of the first impeller. This arrangement contributes to an improvement in static pressure while securing sufficient air flow volume.

Figure 3:
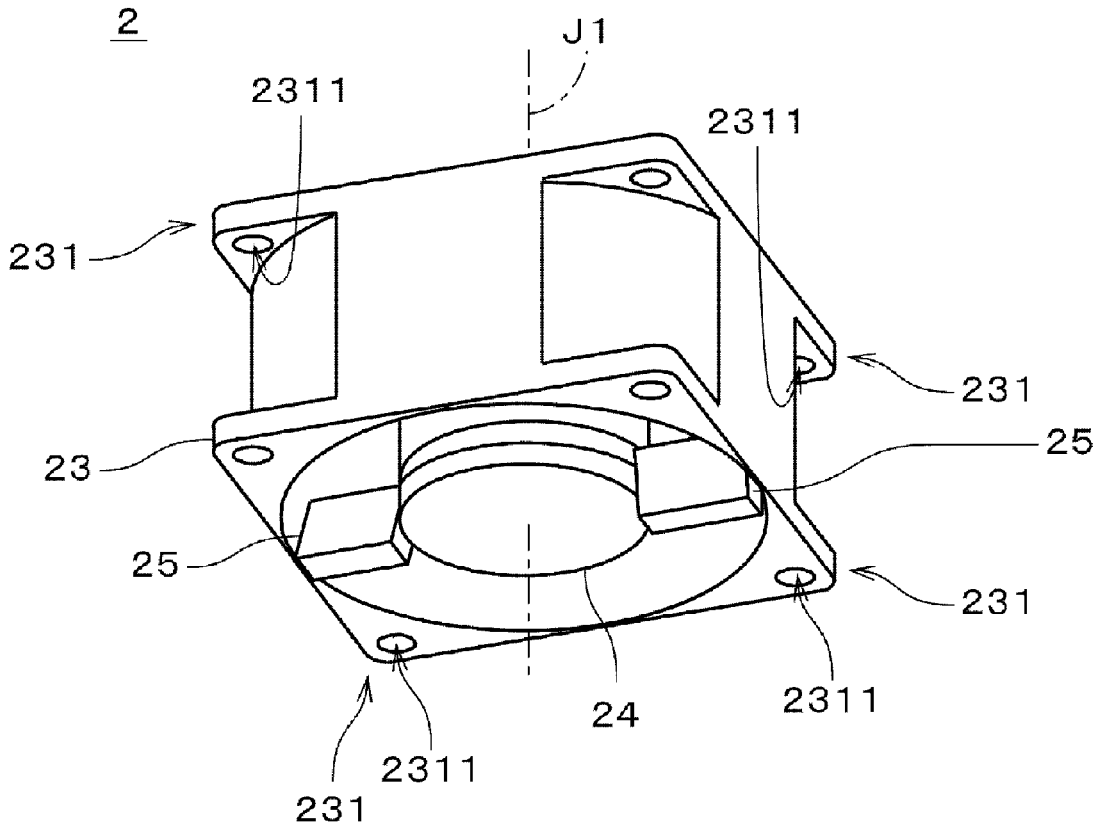
FIG. 3 is a perspective view of a first axial fan.

FIG. 3 is a perspective view of the first axial fan 2 as viewed obliquely from below. In FIG. 3, illustration of the first impeller 21 and a raised portion of the first base portion 24, as described below, is omitted. The first housing 23 preferably has substantially the shape of a quadrangular prism, for example. Through holes 2311 are arranged in four corner portions 231 of both an upper end portion and a lower end portion of the first housing 23. The two first support ribs 25 are arranged on opposite sides of the central axis J1 with respect to each other. Each of the first support ribs 25 extends from the first base portion 24 to the first housing 23, and is slanted with respect to a direction parallel to the central axis J1 and a surface perpendicular to the central axis J1. Each of the first support ribs 25 is preferably flat, with cross-sections perpendicular to a direction in which the first support rib 25 extends thereby substantially defining the shape of a parallelogram. In the serial axial fan 1, the rotation of the first and second impellers 21 and 31 causes the air to flow along the central axis J1 while slanting with respect to the direction parallel to the central axis J1. It is preferable that a slant of each of the first support ribs 25 be substantially parallel to the direction of the air flow.

Figure 4:
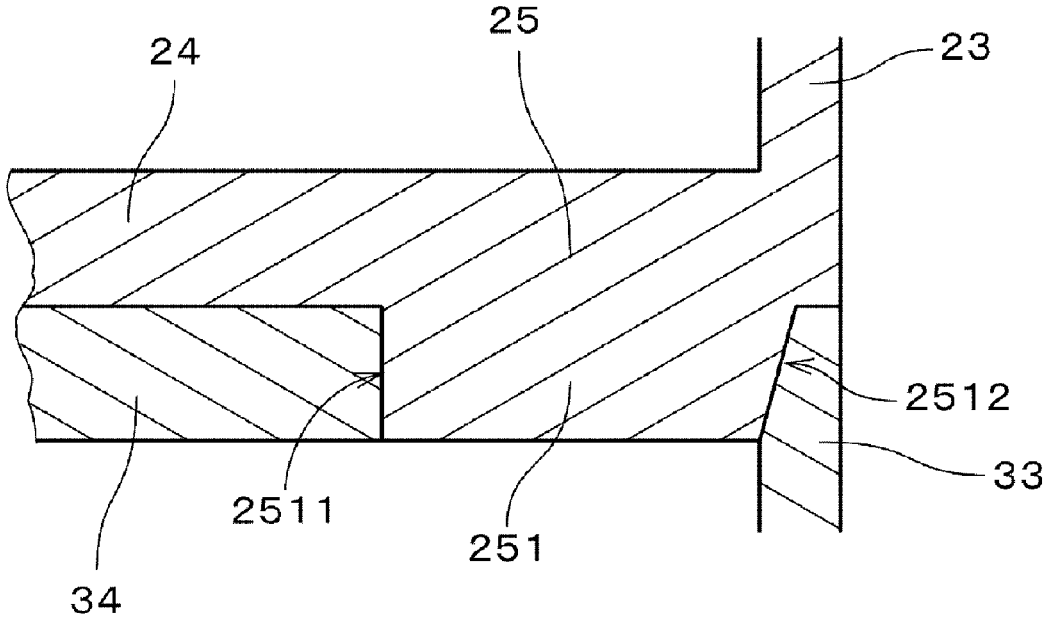
FIG. 4 is a vertical cross-sectional view of a first support rib and its vicinity in the serial axial fan.

FIG. 4 is a vertical cross-sectional view of the first support rib 25 and its vicinity within the serial axial fan 1, schematically illustrating the shape of the first support rib 25 in cross-section. The first support rib 25 includes a portion (hereinafter referred to as a "lower portion 251") protruding downward relative to the first base portion 24. A radially inward end surface 2511 of the lower portion 251 is in contact with an outer circumference of the second base portion 34 in the second axial fan 3, whereas a radially outward end surface 2512 of the lower portion 251 is in contact with an inner side surface of the second housing 33.

In this manner, the first support rib 25 extends across a boundary between the first and second base portions 24 and 34.

Figure 5:
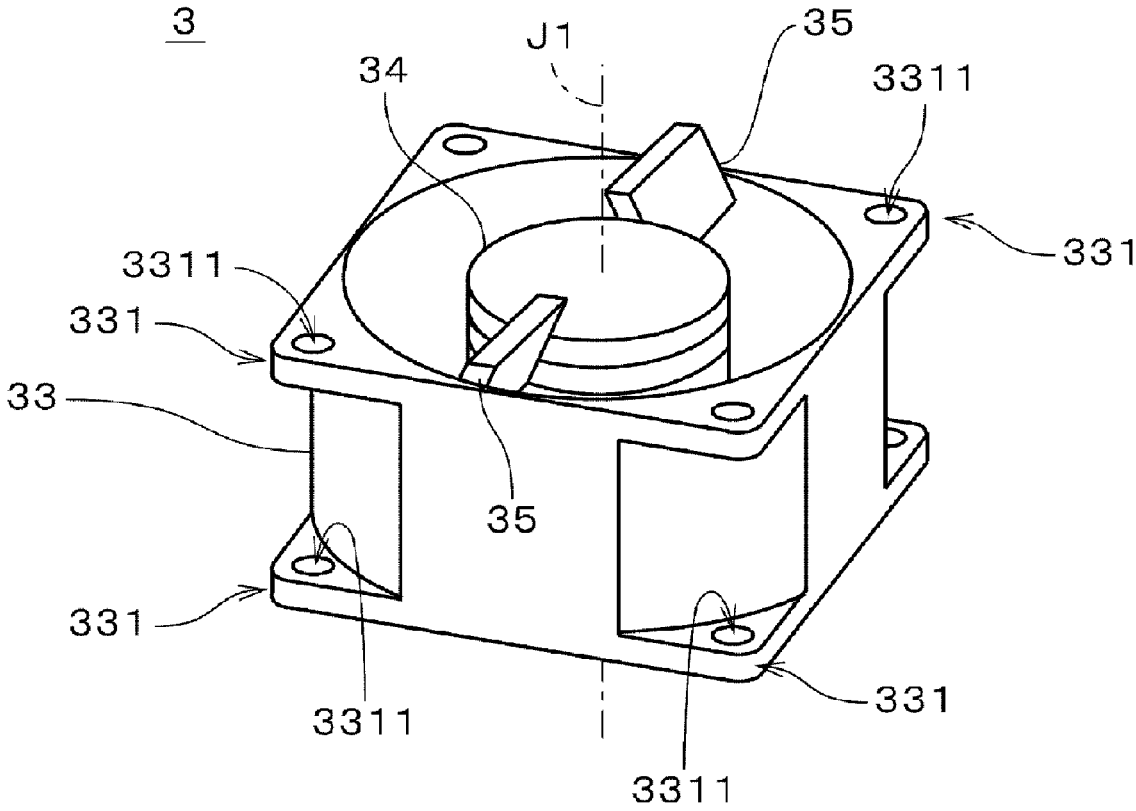
FIG. 5 is a perspective view of a second axial fan.

FIG. 5 is a perspective view of the second axial fan 3 as viewed obliquely from above. In FIG. 5, illustration of the second impeller 31 and a projecting portion of the second base portion 34, as described below, is omitted. The second housing 33 preferably has substantially the shape of a quadrangular prism, for example. Through holes 3311 are arranged in four corner portions 331 of both an upper end portion and a lower end portion of the second housing 33. The two second support ribs 35 are arranged in a direction in which the first support ribs 25 as illustrated in FIG. 3 would be arranged if they were turned 90 degrees in a clockwise direction about the central axis J1.

In this exemplary serial axial fan, the first and second housings 23 and 33 are placed one upon the other. In this situation, the two first support ribs 25 and the two second support ribs 35 combine to define a support rib set. In the support rib set, the first and second support ribs 25 and 35 are alternately arranged at regular intervals in the circumferential direction.

The second support ribs 35 have substantially the same shape as that of the first support ribs 25 as illustrated in FIG. 3. Each of the second support ribs 35 extends from the second base portion 34 to the second housing 33, and is slanted with respect to the direction parallel to the central axis J1 and the surface perpendicular to the central axis J1. Specifically, each of the second support ribs 35 is preferably flat, with cross-sections perpendicular to a direction in which the second support rib 35 extends substantially defining the shape of a parallelogram. Also, as with the first support ribs 25, it is preferable that a slant of each of the second support ribs 35 be substantially parallel to the direction of the air flow.

The slant of each of the first and second support ribs may also be understood as follows. That is, it is preferable that each of the first and second support ribs project in such an orientation as to substantially follow the direction of the air flow produced by the first impeller, and be slanted with respect to the direction parallel to the central axis J1.

Figure 6:
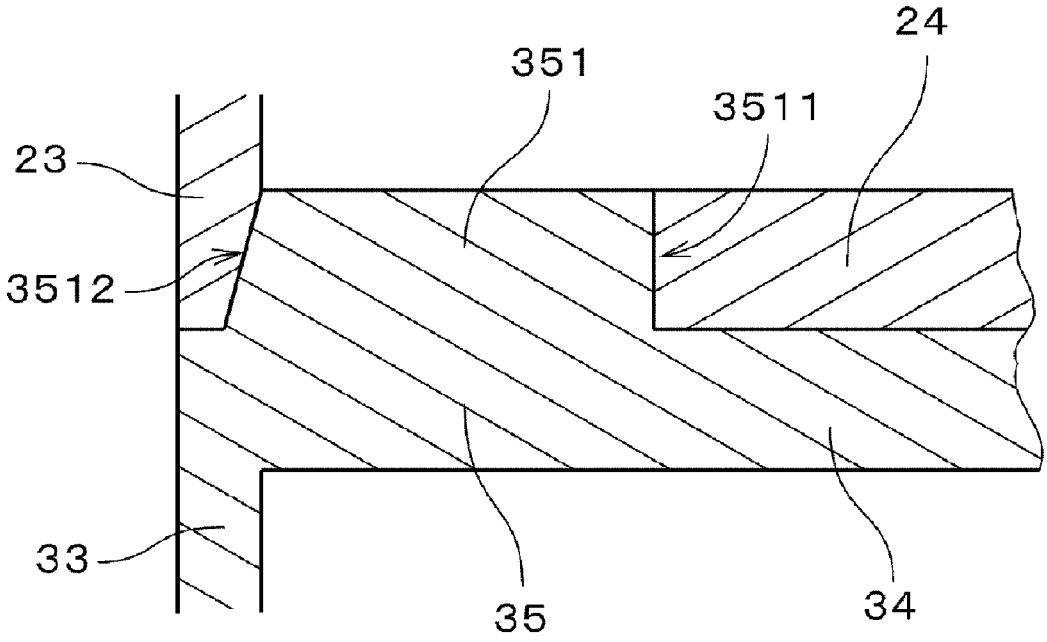
FIG. 6 is a vertical cross-sectional view of a second support rib and its vicinity in the serial axial fan.

FIG. 6 is a vertical cross-sectional view of the second support rib 35 and its vicinity in the serial axial fan 1, schematically illustrating the shape of the second support rib 35 in cross-section. The second support rib 35 includes a portion (hereinafter referred to as an "upper portion 351") protruding upward relative to the second base portion 34. A radially inward end surface 3511 of the upper portion 351 is in contact with an outer circumference of the first base portion 24 in the first axial fan 2, whereas a radially outward end surface 3512 of the upper portion 351 is in contact with an inner side surface of the first housing 23.

In this manner, the second support rib 35 extends across the boundary between the first and second base portions and 34.

The first and second support ribs 25 and 35 in the exemplary serial axial fan 1 described above may also be understood as follows. That is, each of the first support ribs has a portion that protrudes toward the second housing 33 to be inserted into the second housing 33, whereas each of the second support ribs 35 has a portion that protrudes toward the first housing 23 to be inserted into the first housing 23.

Figure 7:
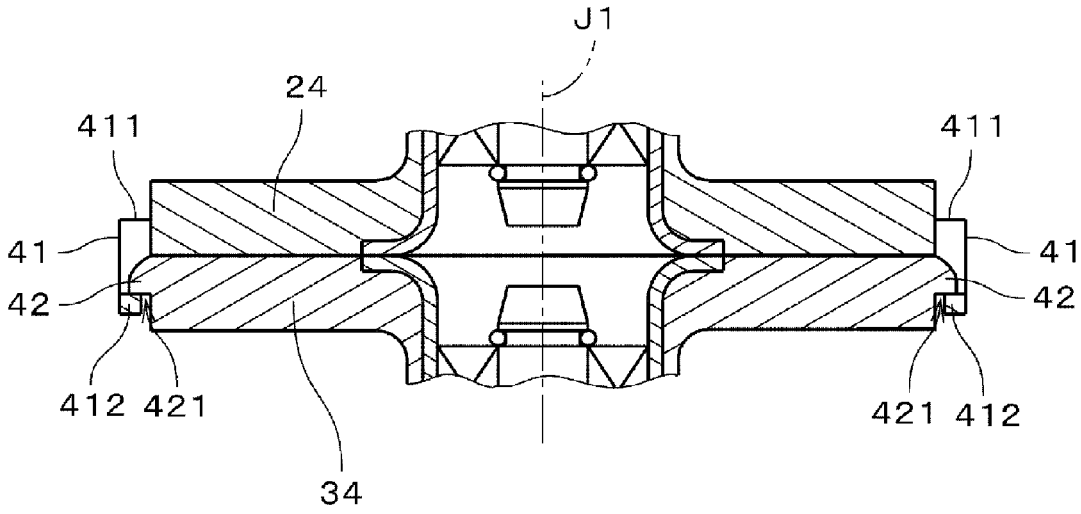
FIG. 7 is a vertical cross-sectional view of first and second base portions and their vicinity in the serial axial fan.

FIG. 7 is a vertical cross-sectional view of the first and second base portions 24 and 34 fit tightly together and their vicinity in the serial axial fan 1, drawn along a different direction from that of FIG. 2. The first base portion preferably has, on its outer circumference, two U-shaped first engagement portions 41 protruding toward the second base portion 34. The second base portion 34 preferably has two raised second engagement portions 42, each arranged at a position corresponding to a separate one of the first engagement portions 41. In the serial axial fan 1, the first and second engagement portions 41 and 42 paired with each other are engaged with each other in the direction parallel to the central axis J1. As a result, relative positions of the first and second base portions 24 and 34 in the direction parallel to the central axis J1 are fixed.

Figure 8:
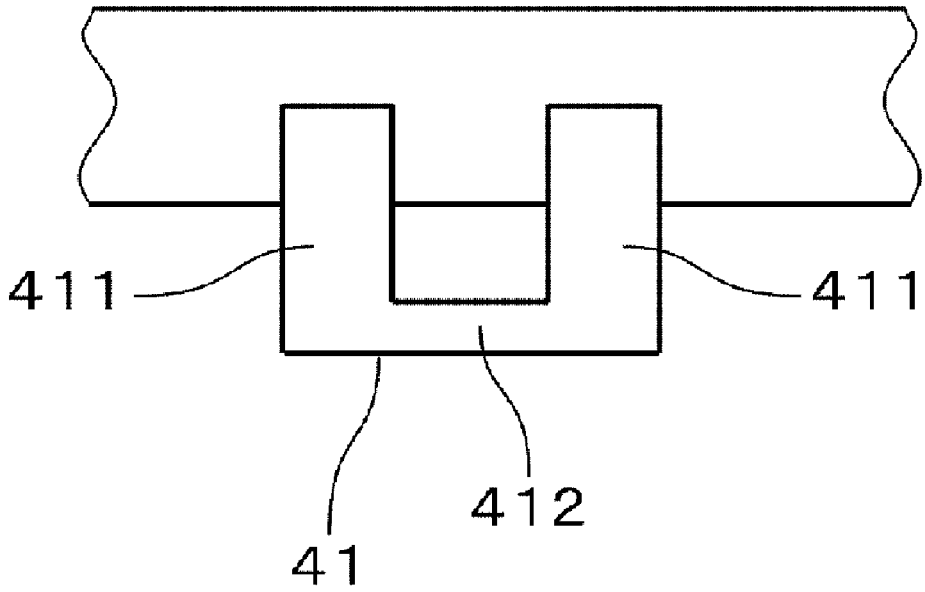
FIG. 8 is a front view of a first engagement portion.

FIG. 8 is a front view of one of the first engagement portions 41 in the first base portion 24 as viewed radially from an outside. As illustrated in FIG. 8, the first engagement portion 41 preferably defines a U-shape when viewed radially from the outside. The first engagement portion 41 has two side portions 411 extending parallel to the central axis J1 (see FIG. 7) and a lower end portion 412 arranged to connect lower ends of the two side portions 411.

Figure 9:
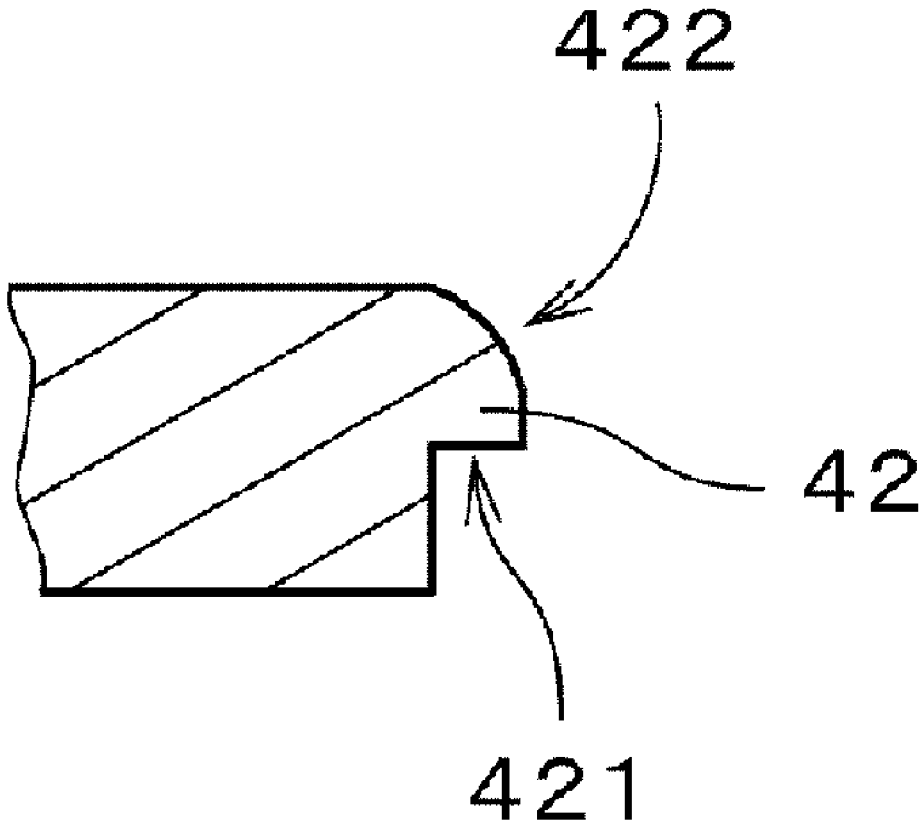
FIG. 9 is a cross-sectional view of a second engagement portion.

FIG. 9 is an enlarged cross-sectional view of one of the second engagement portions 42 in the second base portion 34. As illustrated in FIG. 9, the second engagement portion 42 has a lower surface 421 and a sloping surface 422.

Referring to FIG. 7, when the first and second base portions 24 and 34 are fit tightly together, the lower end portion 412 of the first engagement portion 41 and the lower surface 421 of the second engagement portion 42 are in contact with each other. Note that the second engagement portion 42 may be either in circumferential contact with the two side portions 411 of the first engagement portion 41, or opposed to the two side portions 411 with gaps defined therebetween.

Figure 10:
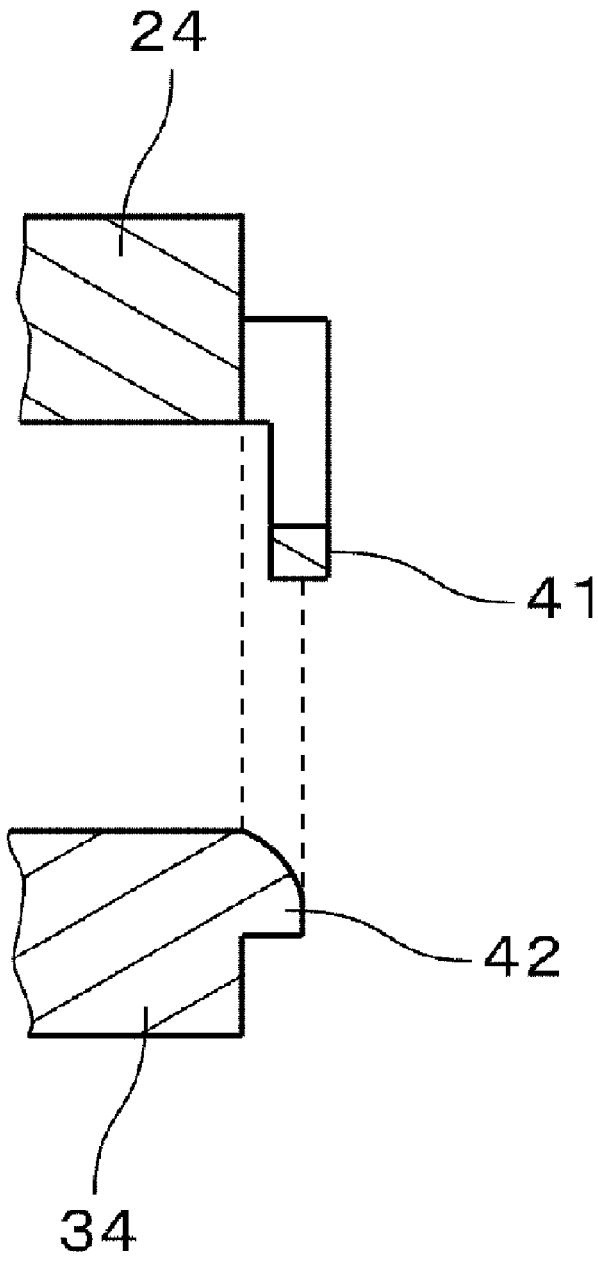
FIGS. 10, 11, and 12 are cross-sectional views of the first and second engagement portions.

When the first and second axial fans 2 and 3 are coupled together, the first and second housings 23 and 33 are first arranged to be substantially coaxial with and opposite to each other. At this time, referring to FIG. 10, the first engagement portion 41 of the first base portion 24 and the second engagement portion 42 of the second base portion 34 which are paired with each other are opposed to each other.

Next, the first and second housings 23 and 33 are brought closer to each other so that the lower end portion of the first housing 23 and the upper end portion of the second housing 33 are brought into contact with each other, and the first and second base portions 24 and 34 are brought into contact with each other. In this manner, the first and second axial fans 2 and 3 are coupled together.

Figure 11:
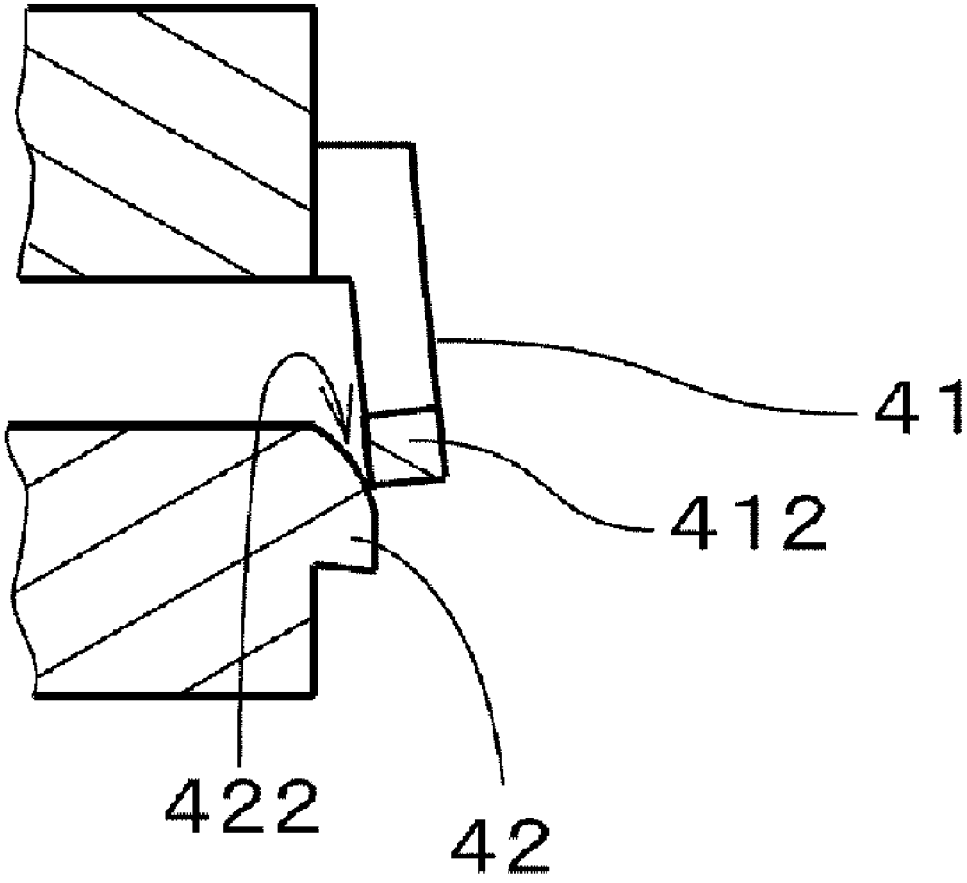
Figure 12:
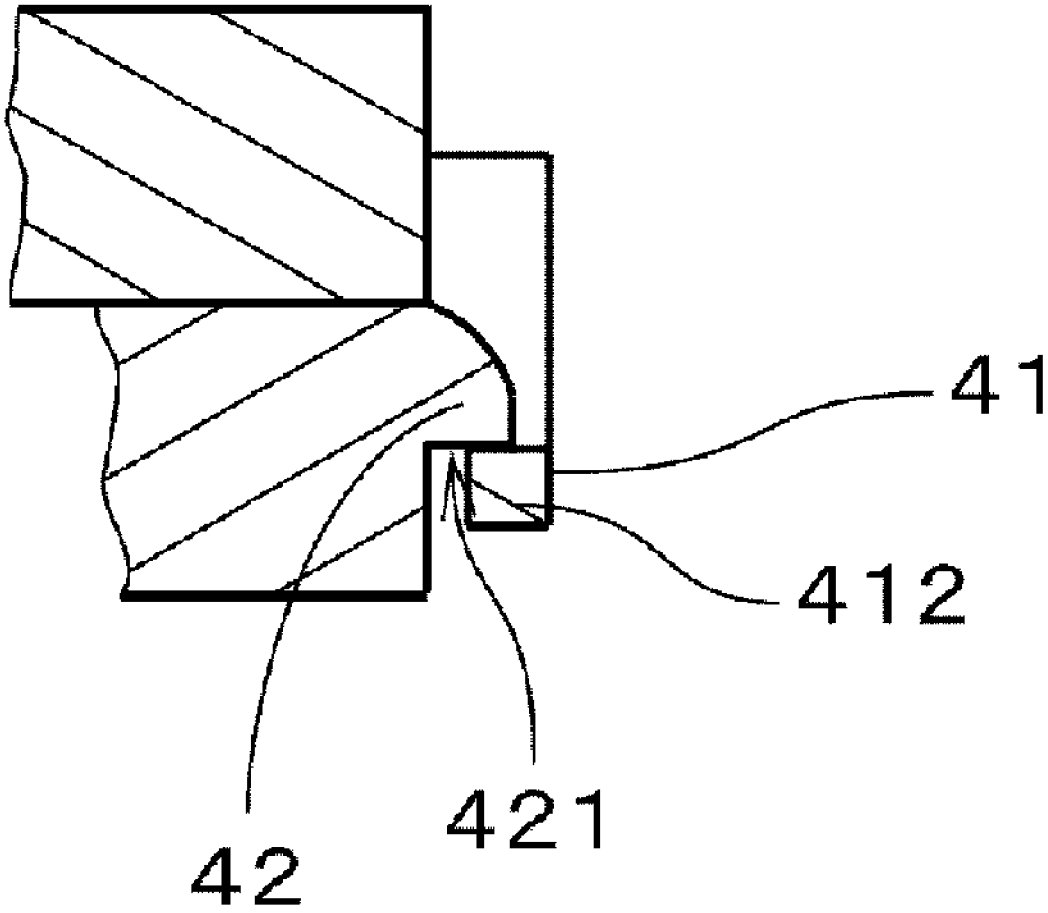

At this time, as illustrated in FIG. 11, the lower end portion 412 of the first engagement portion 41 and the sloping surface 422 of the second engagement portion 42 are brought into contact with each other. Then, the first engagement portion 41 is elastically deformed to bend to the right as illustrated in FIG. 11 while the lower end portion 412 thereof slides over the sloping surface 422, and thereafter the first engagement portion 41 recovers its original shape because of its resilience. As a result, as illustrated in FIG. 12, the first and second engagement portions 41 and 42 are engaged with each other.

Thereafter, the through holes 2311 (see FIG. 1) in the lower end portion of the first housing 23 and the through holes 3311 (see FIG. 5) in the upper end portion of the second housing 33 are fastened together via screws or the like (not shown), so that the first and second housings 23 and 33 are fixed together.

In the serial axial fan 1 as described above, as illustrated in FIG. 7, the first and second base portions 24 and 34 are fixed together via the two pairs of engagement portions. In addition, the first and second housings 23 and 33 are fixed together via, for example, screws or the like, which increases the intensity of the coupling between the first and second axial fans 2 and 3.

The structure of the serial axial fan 1 according to the first preferred embodiment and an operation of fixing the first and second axial fans 2 and 3 together have been described above.

Notice here that in related-art serial axial fans, support ribs in two fans are placed one upon the other in the direction parallel to the central axis J1. As such, a slight gap or displacement between the associated support ribs causes turbulence in the air flow.

In contrast, in the serial axial fan 1 according to the first preferred embodiment, the first and second support ribs 25 and 35, which combine to define the support rib set, are alternately arranged at regular intervals in the circumferential direction, as described above. Since no two support ribs are placed one upon the other, a reduction in the turbulence in the air flow caused by the support ribs is achieved. This contributes to reducing noise and a decrease in the volume of air exiting the fan.

In addition, arranging the first and second support ribs 25 and 35 at regular intervals in the circumferential direction contributes to a further reduction in the turbulence in the air flow. Moreover, the substantially same shape of the first and second support ribs 25 and 35 also contributes to a further reduction in the turbulence in the air flow.

As described above, both the first and second support ribs 25 and 35 extend across the boundary between the first and second base portions 24 and 34. In other words, regarding each of the first and second support ribs 25 and 35, upper and lower edges of the support rib, extending along a direction in which the support rib extends (a substantially radial direction), are positioned within the first and second housings 23 and 33, respectively. This enables the support ribs to have a sufficiently large dimension in a direction substantially parallel to the central axis J1, to ensure rigidity of the support ribs.

Moreover, the first and second support ribs 25 and 35 are arranged alternately in the circumferential direction. This enables the first base portion 24 of the first axial fan 2 and the second base portion 34 of the second axial fan 3 to be securely supported.

As described above, in the serial axial fan 1, the first and second base portions 24 and 34, which are individual integral portions, are fixed together via the two pairs of engagement portions. This allows vibration components in the first and second base portions 24 and 34 to cancel each other out. This contributes to reducing the vibration in the first and second base portions 24 and 34.

Still further, since the first and second base portions 24 and 34 are fixed together, the distribution of natural frequencies of the serial axial fan 1 is such that unfavorable vibration components are reduced, as compared with that of a serial axial fan in which base portions are not fixed together.

Second Preferred Embodiment

Figure 13:
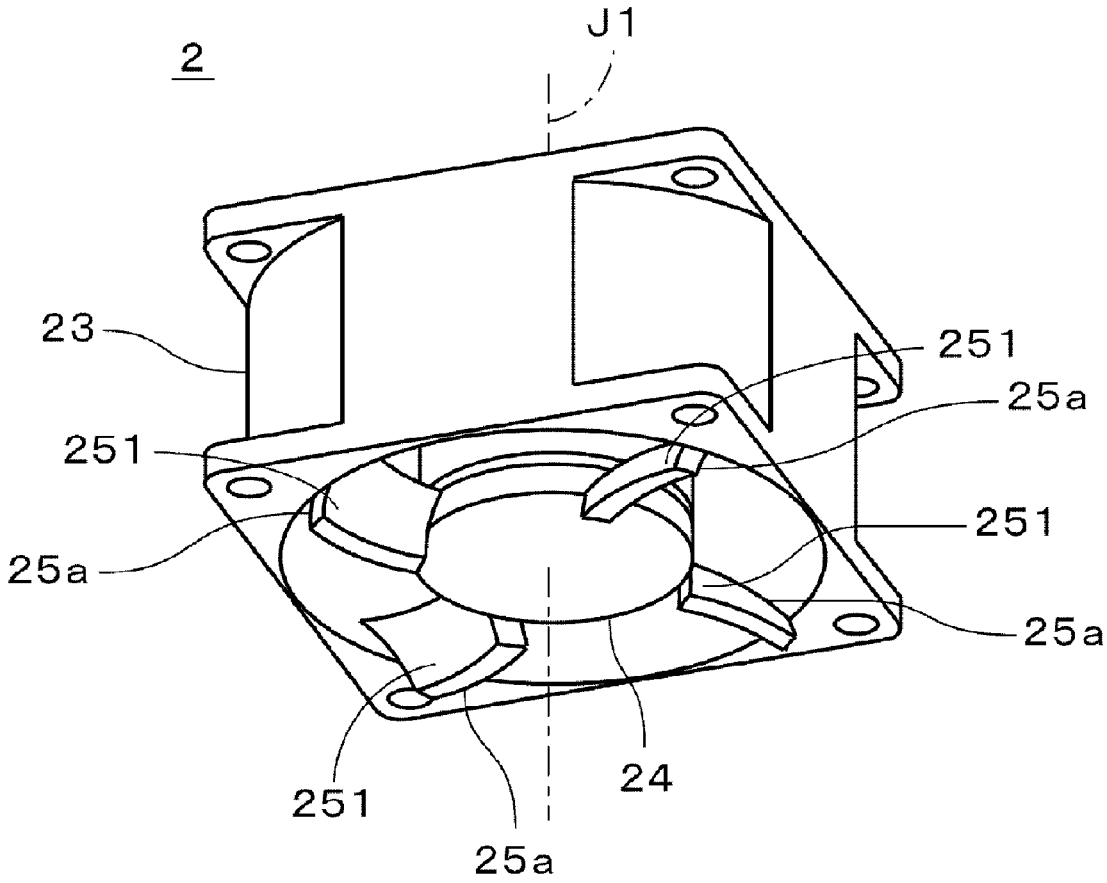
FIG. 13 is a perspective view of a first axial fan in a serial axial fan according to a second preferred embodiment of the present invention.
Figure 14:
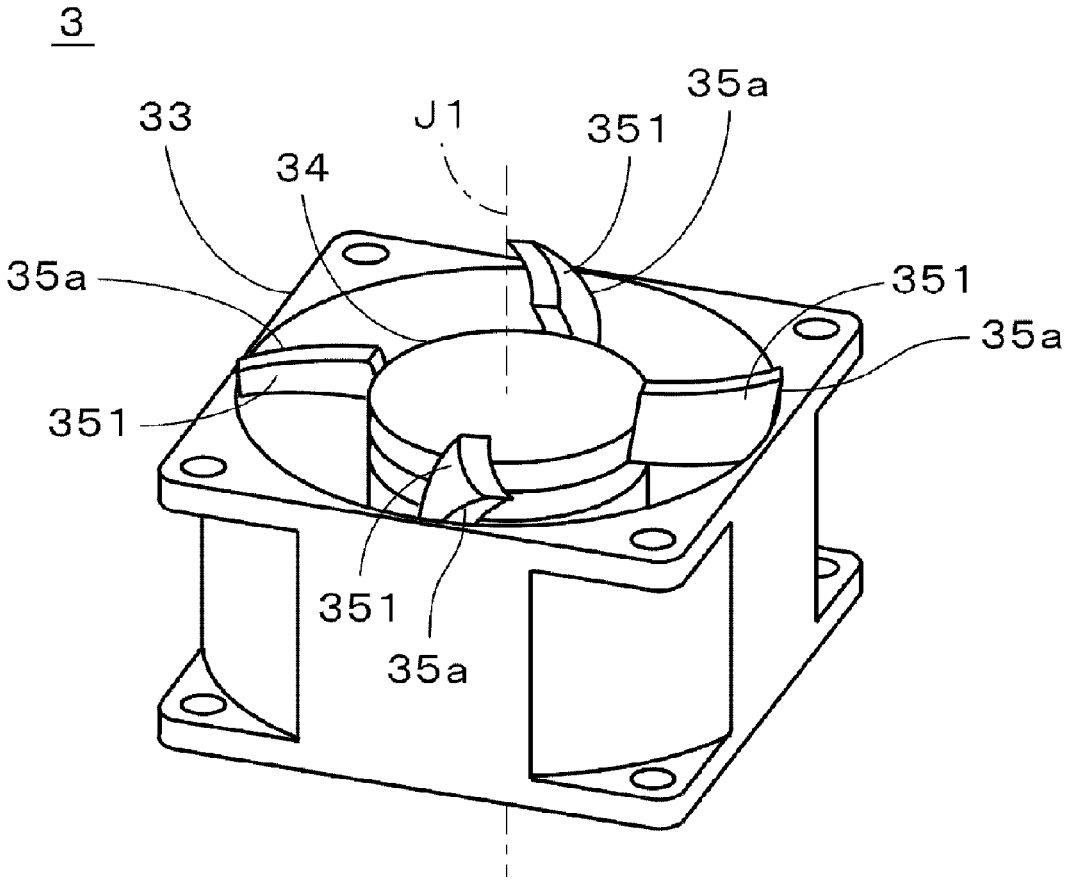
FIG. 14 is a perspective view of a second axial fan.

FIGS. 13 and 14 illustrate first and second axial fans 2 and 3, respectively, in a serial axial fan according to a second preferred embodiment. FIGS. 13 and 14 correspond to FIGS. 3 and 5, respectively, which have been referred to in the description of the first preferred embodiment.

According to the second preferred embodiment, in the first axial fan 2, four first support ribs 25*a* are arranged at regular intervals in the circumferential direction. The first support ribs 25*a* are different in shape from the first support ribs 25 in the first axial fan 2 as illustrated in FIG. 3. The first axial fan 2 is preferably identical in structure to the first axial fan 2 as illustrated in FIG. 3, except for the first support ribs 25*a*. In the second axial fan 3, four second support ribs 35*a* are arranged at regular intervals in the circumferential direction. The second support ribs 35*a* are different in shape from the second support ribs 35 in the second axial fan 3 as illustrated in FIG. 5. The second axial fan 3 is preferably identical in structure to the second axial fan 3 as illustrated in FIG. 5, except for the second support ribs 35*a*.

In the serial axial fan according to the second preferred embodiment, the four first support ribs 25*a* as illustrated in FIG. 13 and the four second support ribs 35*a* as illustrated in FIG. 14 combine to define a support rib set. In this support rib set, the first and second support ribs 25*a* and 35*a* are alternately arranged at regular intervals in the circumferential direction.

Although not shown in FIG. 13, the same first engagement portions as the first engagement portions 41 as illustrated in FIG. 7 are provided in the first base portion 24 of the first axial fan 2. Although not shown in FIG. 14, the same second engagement portions as the second engagement portions 42 as illustrated in FIG. 7 are provided in the second base portion 34 of the second axial fan 3.

In the second preferred embodiment, as well as in the first preferred embodiment, the first and second base portions 24 and 34 are fixed together via the pairs of first and second engagement portions 41 and 42. In the following description, members or portions that have equivalents in the serial axial fan 1 are assigned the same reference numerals as their equivalents.

As illustrated in FIG. 13, each of the first support ribs 25*a* extends from the first base portion 24 to the first housing 23. Each of the first support ribs 25*a* is preferably flat or substantially flat, with cross-sections perpendicular to a direction in which the first support rib 25*a* extends substantially defining the shape of a circular arc (i.e., has a typical shape of a stationary vane).

In each of the first support ribs 25*a*, the lower portion 251, which protrudes downward relative to the first base portion 24, and the remaining portion, excluding the lower portion 251, are positioned within the second housing 33 and the first housing 23, respectively. Thus, the lower portion 251 and the remaining portion, excluding the lower portion 251, can be considered as a portion for the second impeller 31 (see FIG. 2) and a portion for the first impeller 21 (see FIG. 2), respectively.

As illustrated in FIG. 14, the second support ribs 35*a*, which extend from the second base portion 34 to the second housing 33, have substantially the same shape as the first support ribs 25*a* of the first axial fan 2 as illustrated in FIG. 13.

In each of the second support ribs 35*a*, the upper portion 351, which protrudes upward relative to the second base portion 34, and the remaining portion, excluding the upper portion 351, are positioned within the first housing 23 and the second housing 33, respectively. Thus, the upper portion 351 and the remaining portion, excluding the upper portion 351, can be considered as a portion of the first impeller 21 and a portion of the second impeller 31, respectively.

In the serial axial fan according to the second preferred embodiment, the first and second support ribs 25*a* and 35*a*, which combine to define the support rib set, are alternately arranged at regular intervals in the circumferential direction. That is, no two support ribs are placed one upon the other. Therefore, as in the first preferred embodiment, a reduction in the turbulence in the air flow is achieved.

Both the first and second support ribs 25*a* and 35*a* extend across the boundary between the first and second base portions 24 and 34. Therefore, as in the first preferred embodiment, the rigidity of the support ribs is ensured.

Third Preferred Embodiment

Figure 15:
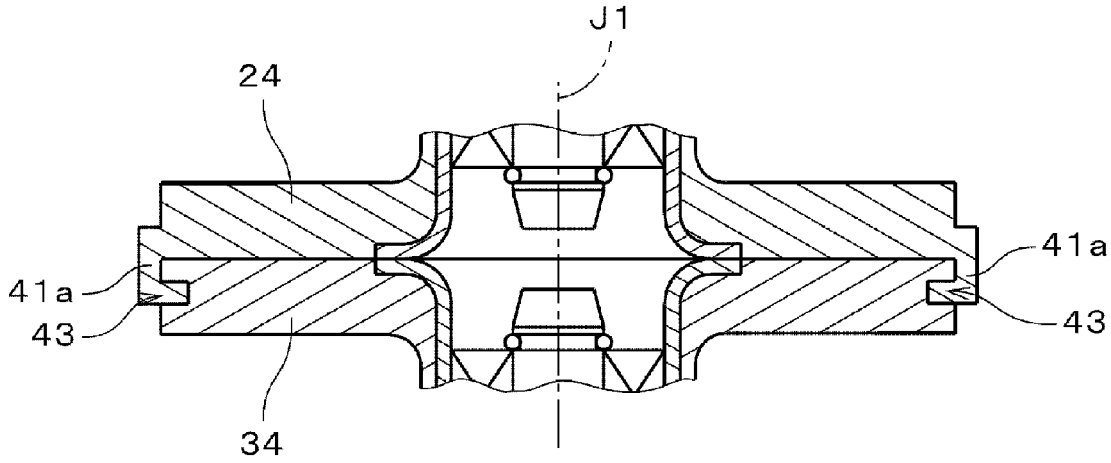
FIG. 15 is a vertical cross-sectional view of first and second base portions and their vicinity in the serial axial fan.

FIG. 15 illustrates the first base portion 24 of a first axial fan and the second base portion 34 of a second axial fan, in a serial axial fan according to a third preferred embodiment. FIG. 15 is a vertical cross-sectional view, and corresponds to FIG. 7.

The third preferred embodiment adopts a different engagement mechanism from the first and second engagement portions used in the first and second preferred embodiments described above.

The first axial fan according to the third preferred embodiment is preferably identical in structure to the first axial fan 2 as illustrated in FIG. 2, except for the first base portion 24. Similarly, the second axial fan according to the third preferred embodiment is preferably identical in structure to the second axial fan 3 as illustrated in FIG. 2, except for the second base portion 34. In the following description, members or portions that have equivalents in the serial axial fan 1 are assigned the same reference numerals as their equivalents.

Figure 16:
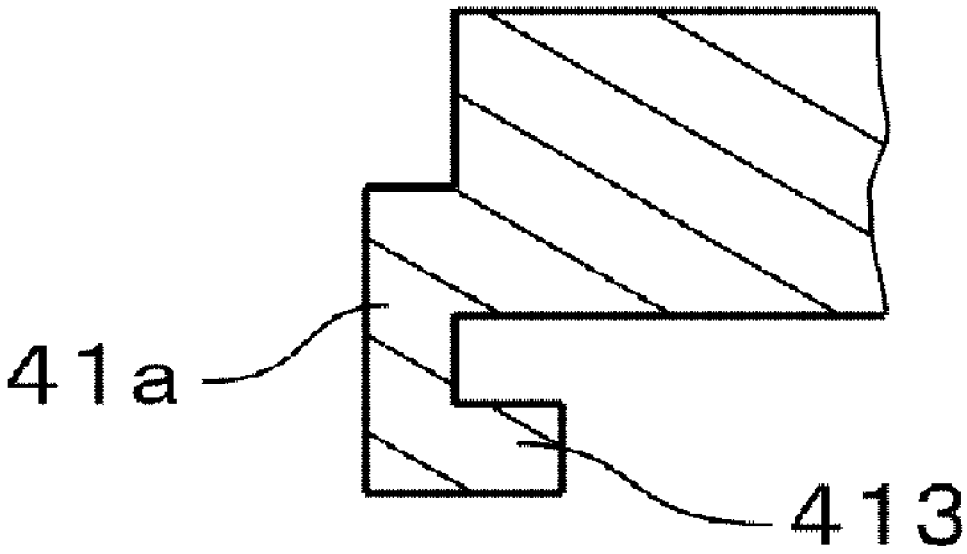
FIG. 16 is a cross-sectional view of a first engagement portion.

FIG. 16 is a cross-sectional view of one of the first engagement portions 41*a* of the first base portion 24. As illustrated in FIG. 16, the first engagement portion 41*a* according to the third preferred embodiment is substantially L-shaped in cross section.

Figure 17:
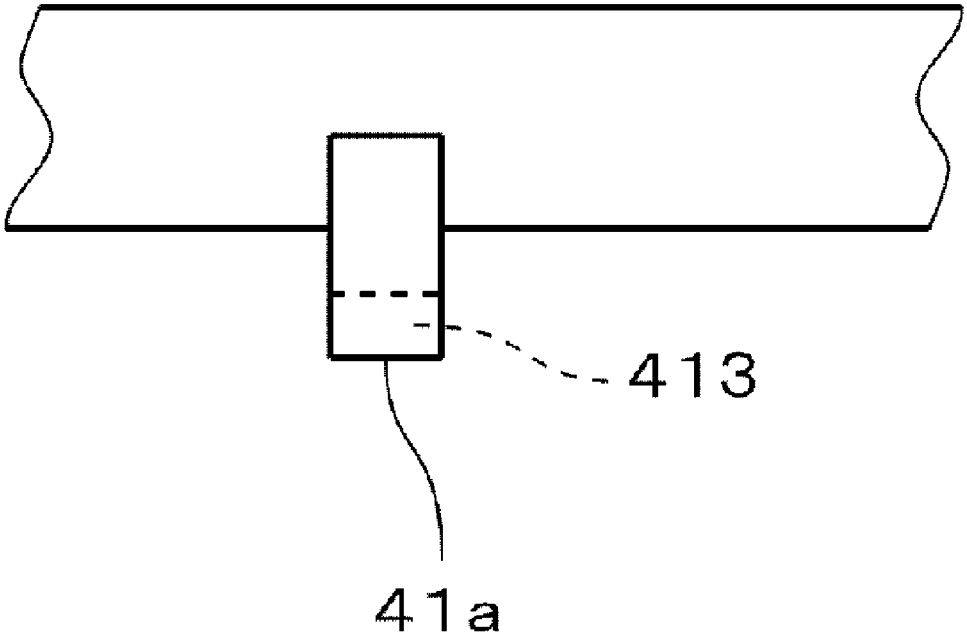
FIG. 17 is a front view of the first engagement portion.

FIG. 17 is a front view of the first engagement portion 41*a* as viewed radially from an outside. As illustrated in FIGS. 16 and 17, the first engagement portion 41*a* projects downward from the outer circumference of the first base portion 24, and a lower end portion 413 of the first engagement portion 41*a* extends radially inward.

Figure 18:
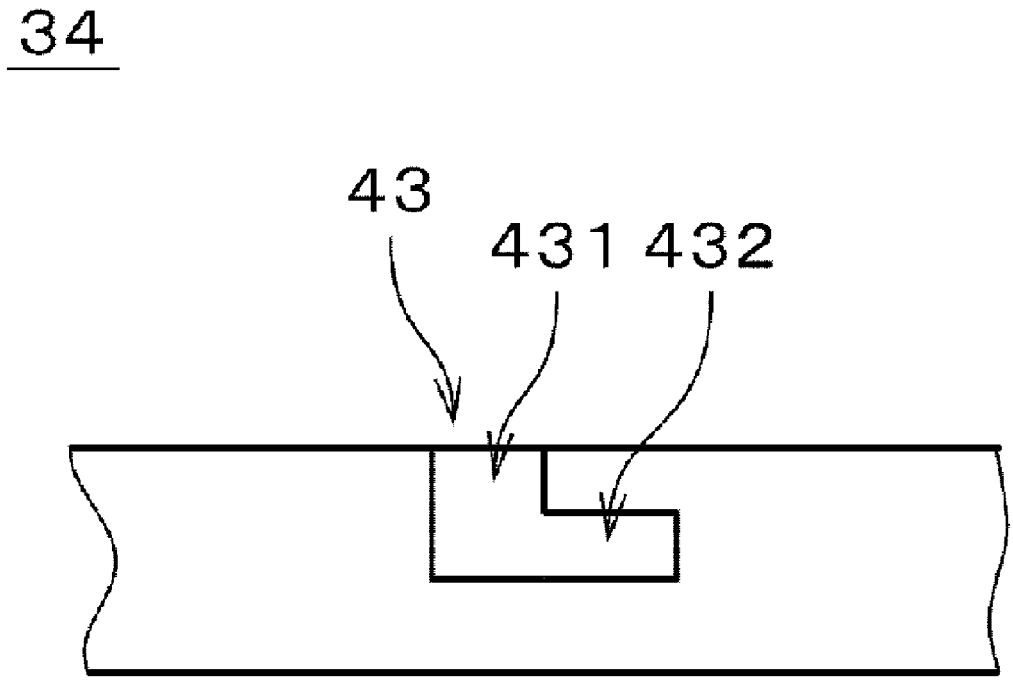
FIG. 18 is a front view of a second engagement portion.

FIG. 18 is a front view of one of the second engagement portions 43 of the second base portion 34 as viewed radially from the outside. The second engagement portion 43 defines a recess and is substantially L-shaped in front view. The second engagement portion 43 has a first groove portion 431, which extends a certain distance downward from an upper end of the second base portion 34, and a second groove portion 432, which extends from a lower portion of the first groove portion 431 in a circumferential direction (to the right in FIG. 18). The first and second groove portions 431 and 432 combine to form the L-shape.

Figure 19:
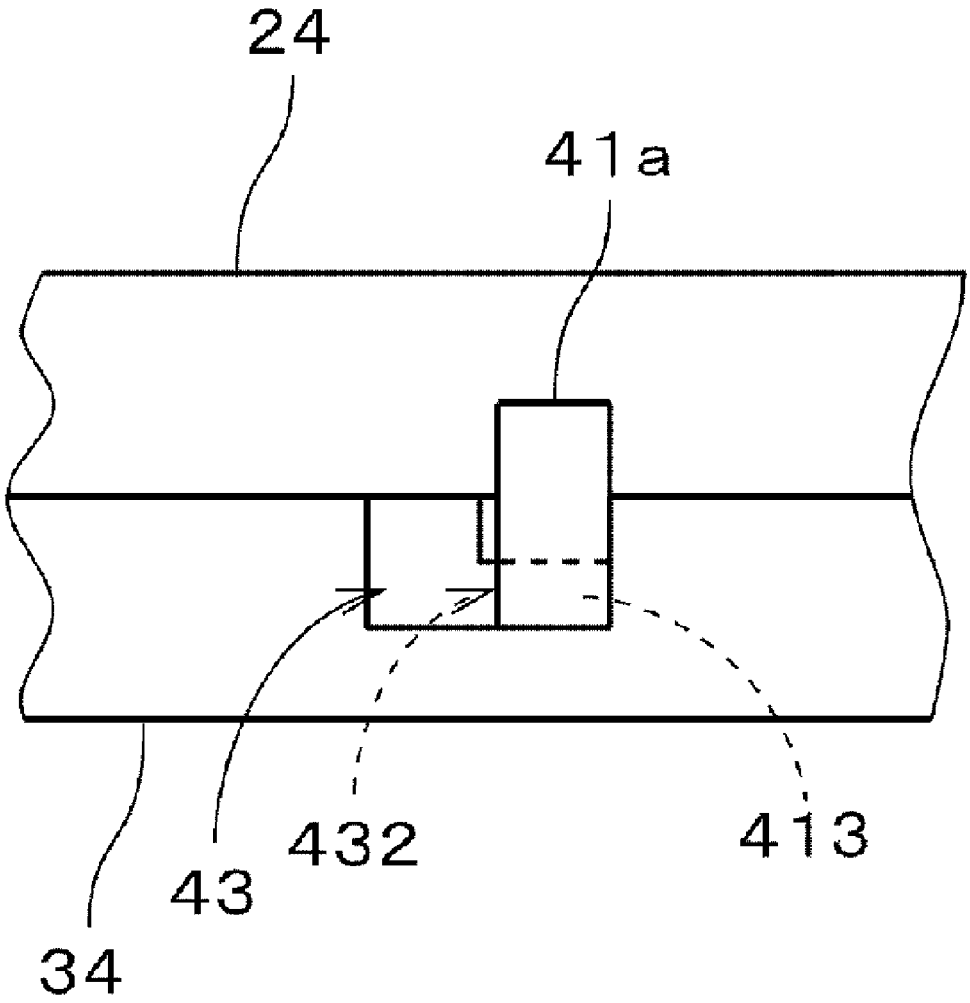
FIG. 19 is a front view of the first and second engagement portions.

FIG. 19 illustrates a situation in which the first and second base portions 24 and 34 are fit tightly together. In the third preferred embodiment, the lower end portion 413 of the first engagement portion 41*a* is positioned within the second groove portion 432 of the second engagement portion 43, so that the first and second engagement portions 41*a* and 43 are engaged with each other.

When the first and second axial fans are coupled together, the first and second housings 23 and 33 are first arranged to be coaxial or substantially coaxial with and opposite to each other, while the associated corner portions thereof are displaced one from the other in the circumferential direction. In this situation, where the associated corner portions are displaced one from the other in the circumferential direction, the first engagement portion 41*a* is positioned opposite to the first groove portion 431 of the second engagement portion 43.

Next, the first and second housings 23 and 33 are brought closer to each other so that the lower end portion of the first housing 23 and the upper end portion of the second housing 33 are brought into contact with each other, and the first and second base portions 24 and 34 are brought into contact with each other. At this time, the first engagement portion 41*a* is inserted into the first groove portion 431 of the second engagement portion 43.

Then, the first housing 23, which is in contact with the second housing 33, is turned in the circumferential direction relative to the second housing 33, so that the lower end portion 413 of the first engagement portion 41*a* is moved into the second groove portion 432 of the second engagement portion 43. As a result, the lower end portion 413 of the first engagement portion 41*a* and the second groove portion 432 of the second engagement portion 43 are engaged with each other, as illustrated in FIG. 19. Thereafter, the first and second housings 23 and 33 are fixed together via, for example, screws or the like (not shown).

In the third preferred embodiment, the first and second base portions 24 and 34 are fixed together via the first and second engagement portions 41*a* and 43. Therefore, a reduction in vibration is achieved as in the first preferred embodiment.

Other Preferred Embodiments

Some exemplary preferred embodiments of the present invention have been described above. Note, however, that the present invention is not limited to the preferred embodiments described above, and that various other modifications are possible.

For example, the number of first support ribs 25, 25*a* and the number of second support ribs 35, 35*a* may be increased or decreased to any desirable number.

Specifically, both the number of first support ribs 25*a* and the number of second support ribs 35*a* in the second preferred embodiment may be changed to two. The first and second support ribs 25*a* and 35*a* are also alternately arranged at regular intervals in the circumferential direction in a support rib set composed of the two first support ribs 25*a* and the two second support ribs 35*a*.

Further, the number of first support ribs 25, 25*a* and the number of second support ribs 35, 35*a* may be different from each other. Even in this case, a reduction in the turbulence in the air flow in the serial axial fan can be achieved by arranging a plurality of first support ribs and a plurality of second support ribs, which combine to define a support rib set, at regular intervals in the circumferential direction.

In the above-described preferred embodiments, the lower portion 251 of each of the first support ribs 25, 25*a* may not necessarily be in contact with the second base portion 34 and the second housing 33 but may only be in close proximity to the second base portion 34 and the second housing 33. The same is true for the upper portion 351 of each of the second support ribs 35, 35*a*.

In the above-described preferred embodiments, a reduction in the turbulence in the air flow is achieved due to the slant of the first support ribs 25, 25*a* and the second support ribs 35, 35*a* being substantially parallel to the direction of the air flow.

In the case where the influence of the support ribs on the air flow is slight, the support ribs may be substantially flat, with cross-sections perpendicular to the central axis J1 defining the shape of a long and narrow rectangle.

It is preferable that the support ribs be substantially flat, but the support ribs may have any desirable shape. For example, each of the support ribs may be bar-shaped, with cross-sections perpendicular to a direction in which the support rib extends defining the shape of a triangle. In this case, it is preferable that each of the support ribs have a surface slanted so as to follow the direction of the air flow, in order to achieve a reduction in the turbulence in the air flow. Even such support ribs can have a sufficiently large dimension in the direction parallel to the central axis J1 when a portion thereof on the first impeller 21 side is positioned within the first housing 23 and a portion thereof on the second impeller 31 side is positioned within the second housing 33, to ensure the rigidity of the support ribs.

In the above-described preferred embodiments, the first and second base portions 24 and 34 may not necessarily be in contact with each other, but may only be in close proximity to each other. Even in this case, relative positions of the first and second base portions 24 and 34 can be fixed by use of the two first engagement portions 41 and the two second engagement portions 42.

Also, the first and second axial fans 2 and 3 according to a preferred embodiment of the present invention may be used as two axial fans connected in series within a serial axial fan including three or more axial fans. In other words, the shapes of the support ribs and the methods of fixing the first and second base portions 24 and 34 together as described above with reference to the preferred embodiments may be used in two axial fans within a serial axial fan including three or more axial fans connected in series.

Further, in general, the rotation direction of the second axial fan arranged downstream may be either a clockwise or counterclockwise direction. For example, in the preferred embodiments described above, the first and second impellers 21 and 31 in the serial axial fan may be arranged to rotate in the same direction. In this case, it is preferable that the support ribs be shaped as stationary vanes, as the first and second support ribs 25*a* and 35*a*.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A serial axial fan comprising:

a first axial fan including a first base portion, a first motor portion supported by the first base portion, a first impeller including a plurality of first blades, a first housing arranged to enclose an outer circumference of the first impeller, and a plurality of first support ribs arranged to connect the first base portion to the first housing; and a second axial fan including a second base portion, a second motor portion supported by the second base portion, a second impeller including a plurality of second blades, a second housing arranged to enclose an outer circumference of the second impeller, and a plurality of second support ribs arranged to connect the second base portion to the second housing; wherein the first axial fan and the second axial fan are coupled to each other such that the first and second base portions either contact one another or are adjacent to each other but not in contact with one another;

a first portion of each of the first support ribs on a side of the first impeller is positioned within the first housing, and a second portion of each of the first support ribs on a side of the second impeller is positioned within the second housing; and a first portion of each of the second support ribs on the second impeller side is positioned within the second housing, and a portion of each of the second support ribs on the first impeller side is positioned within the first housing.

2. The serial axial fan according to claim 1, wherein the number of first support ribs and the number of second support ribs are equal to each other; and the first and second support ribs are arranged alternately in a circumferential direction and centered about a central axis.

3. The serial axial fan according to claim 2, wherein the first and second support ribs are arranged at regular intervals in the circumferential direction.

4. The serial axial fan according to claim 1, wherein the first and second support ribs are arranged at regular intervals in a circumferential direction such that the first and second support ribs are centered about a central axis.

5. The serial axial fan according to claim 1, wherein each of a number of first support ribs and a number of second support ribs is two.

6. The serial axial fan according to claim 1, wherein the first and second support ribs have the same shape.

7. The serial axial fan according to claim 1, wherein each of the first support ribs is flat and extends from the first base portion to the first housing; and each of the second support ribs is flat and extends from the second base portion to the second housing.

8. The serial axial fan according to claim 7, wherein each of the first and second support ribs extend in such an orientation as to follow a direction of air flow produced by the first impeller, and are slanted with respect to a direction parallel to a central axis.

9. The serial axial fan according to claim 1, wherein the first base portion includes a first engagement portion;

the second base portion includes a second engagement portion arranged to be engaged with the first engagement portion; and the first and second base portions are in contact with each other, and the first and second engagement portions are engaged with each other in a direction parallel to a central axis when the first and second axial fans are coupled together.

10. The serial axial fan according to claim 1, wherein the first and second impellers are arranged to rotate in opposite directions.

* * * * *